US012790823B2

(12) United States Patent
Luis et al.

(10) Patent No.: US 12,790,823 B2
(45) Date of Patent: Nov. 10, 2026

(54) PREFABRICATED INSULATING PANEL

(71) Applicant: SAINT-GOBAIN ISOVER, Courbevoie (FR)

(72) Inventors: David Luis, Breuil le Vert (FR); Alexia Michel, Paris (FR); Pierre Jop, Alfortville (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 202 days.

(21) Appl. No.: 18/576,698

(22) PCT Filed: Jul. 6, 2022

(86) PCT No.: PCT/FR2022/051357
§ 371 (c)(1),
(2) Date: Jan. 4, 2024

(87) PCT Pub. No.: WO2023/281218
PCT Pub. Date: Jan. 12, 2023

(65) Prior Publication Data

US 2024/0287799 A1 Aug. 29, 2024

(30) Foreign Application Priority Data

Jul. 8, 2021 (FR) ..... 2107432

(51) Int. Cl.
*E04C 2/32* (2006.01)
*E04B 2/00* (2006.01)
(Continued)

(52) U.S. Cl.
CPC ..... *E04C 2/32* (2013.01); *E04C 2002/001* (2013.01); *E04C 2/288* (2013.01); *E04C 2/386* (2013.01); *E04C 2/46* (2013.01)

(58) Field of Classification Search
CPC ..... E04C 2002/001; E04C 2/296; E04C 2/34; E04C 2/288; E04C 2/32; E04C 2/386; E04C 2/46; E04B 1/80
See application file for complete search history.

(56) References Cited

U.S. PATENT DOCUMENTS 1,604,097 A * 10/1926 Hewlett ..... E04C 1/40 52/432
3,000,144 A * 9/1961 Kitson ..... E04C 2/205 52/592.1
(Continued)

FOREIGN PATENT DOCUMENTS

CN 113323263 A * 8/2021 ..... E04C 2/284
CN 114687509 A * 7/2022 ..... E04B 2/56
(Continued)

OTHER PUBLICATIONS

Notification under Article 94(3) CBE as issued in European Patent Application No. 22751776.0, dated Jan. 22, 2025.
(Continued)

*Primary Examiner* — Phi D A
(74) *Attorney, Agent, or Firm* — CUSHMAN PARTNERS LLC

(57) ABSTRACT

An insulating panel includes a bottom and a lid linked at their periphery by a side wall forming a housing in which an insulating material is placed, and a retention system in the form of spikes for retaining the insulating material in the panel and preventing it from collapsing.

20 Claims, 12 Drawing Sheets

(51) Int. Cl.

| | |
|---|---|
| *E04C 2/00* | (2006.01) |
| *E04C 2/288* | (2006.01) |
| *E04C 2/38* | (2006.01) |

(56) References Cited

U.S. PATENT DOCUMENTS

| | | | | | |
|---|---|---|---|---|---|
| 3,313,674 | A * | 4/1967 | Mathews | B29C 70/00 | 428/416 |
| 3,875,280 | A * | 4/1975 | Story | B65D 19/0018 | 264/237 |
| 3,885,008 | A * | 5/1975 | Martin | E04C 2/386 | 264/45.3 |
| 4,015,393 | A * | 4/1977 | Warwick | E06B 3/7015 | 52/475.1 |
| 4,573,304 | A * | 3/1986 | Mieyal | E04C 2/36 | 428/116 |
| 4,702,053 | A * | 10/1987 | Hibbard | E04C 2/044 | 52/712 |
| 6,061,986 | A * | 5/2000 | Canada | E04B 1/3555 | 52/DIG. 9 |
| 6,230,409 | B1 * | 5/2001 | Billings | E04C 2/288 | 29/897.3 |
| 7,073,306 | B1 * | 7/2006 | Hagaman | E04B 1/3555 | 249/34 |
| 9,187,915 | B2 * | 11/2015 | Jung | E04C 5/168 | |
| 2024/0368887 | A1 * | 11/2024 | Dombowsky | E04C 2/288 | |

FOREIGN PATENT DOCUMENTS

| | | | | | |
|---|---|---|---|---|---|
| CN | 115012662 | A * | 9/2022 | E04G 21/00 | |
| CN | 116122498 | A * | 5/2023 | E04C 2/296 | |
| CN | 116677132 | A * | 9/2023 | E04C 2/288 | |
| CN | 114592643 | B * | 9/2024 | E04G 21/00 | |
| CN | 118849151 | A * | 10/2024 | E04B 2/82 | |
| CN | 119177733 | A * | 12/2024 | E04G 21/02 | |
| DE | 44 43 857 | A1 | 6/1996 | | |
| DE | 298 10 487 | U1 | 7/1999 | | |
| EP | 0 373 527 | A2 | 6/1990 | | |
| EP | 1041211 | A2 * | 10/2000 | B29C 70/30 | |
| EP | 1 273 730 | A2 | 1/2003 | | |
| EP | 1570984 | A1 * | 9/2005 | B29C 70/088 | |
| EP | 2 644 796 | A2 | 10/2013 | | |
| FR | 2971803 | A1 * | 8/2012 | E04B 1/164 | |
| GB | 2339168 | A * | 1/2000 | B31D 3/0284 | |
| JP | S55-019584 | A | 2/1980 | | |
| KR | 100792243 | B1 * | 1/2008 | E04B 1/80 | |
| KR | 10-0922175 | B1 | 10/2009 | | |
| KR | 20100003862 | A * | 1/2010 | E04B 1/80 | |
| KR | 102821703 | B1 * | 6/2025 | E04F 13/0821 | |
| KR | 102821709 | B1 * | 6/2025 | E04F 13/0866 | |
| KR | 102829885 | B1 * | 7/2025 | E04F 13/0875 | |
| WO | WO 2017/146615 | A1 | 8/2017 | | |

OTHER PUBLICATIONS

International Search Report as issued in International Patent Application No. PCT/FR2022/051357, dated Sep. 28, 2022.

Office Action as issued in Japanese Patent Application No. 2023-580422, dated Mar. 10, 2026.

* cited by examiner

[Fig. 1]
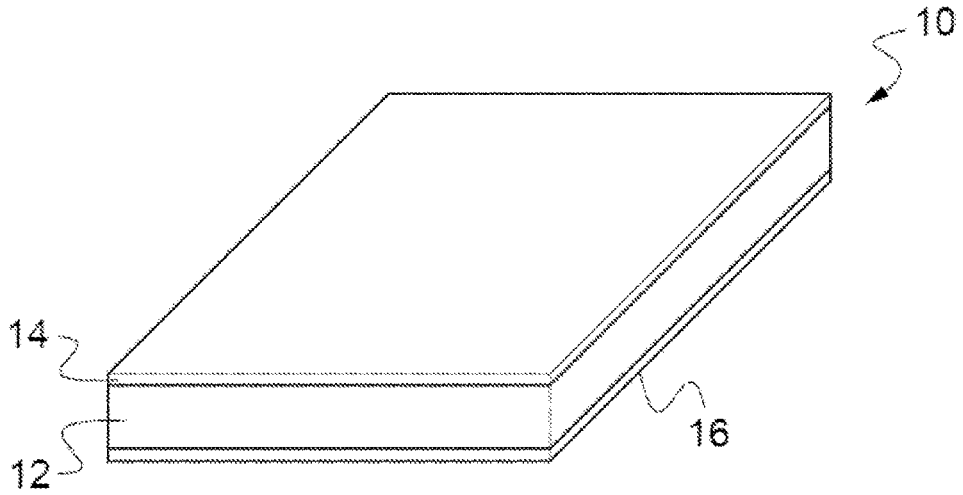
[Fig. 2]
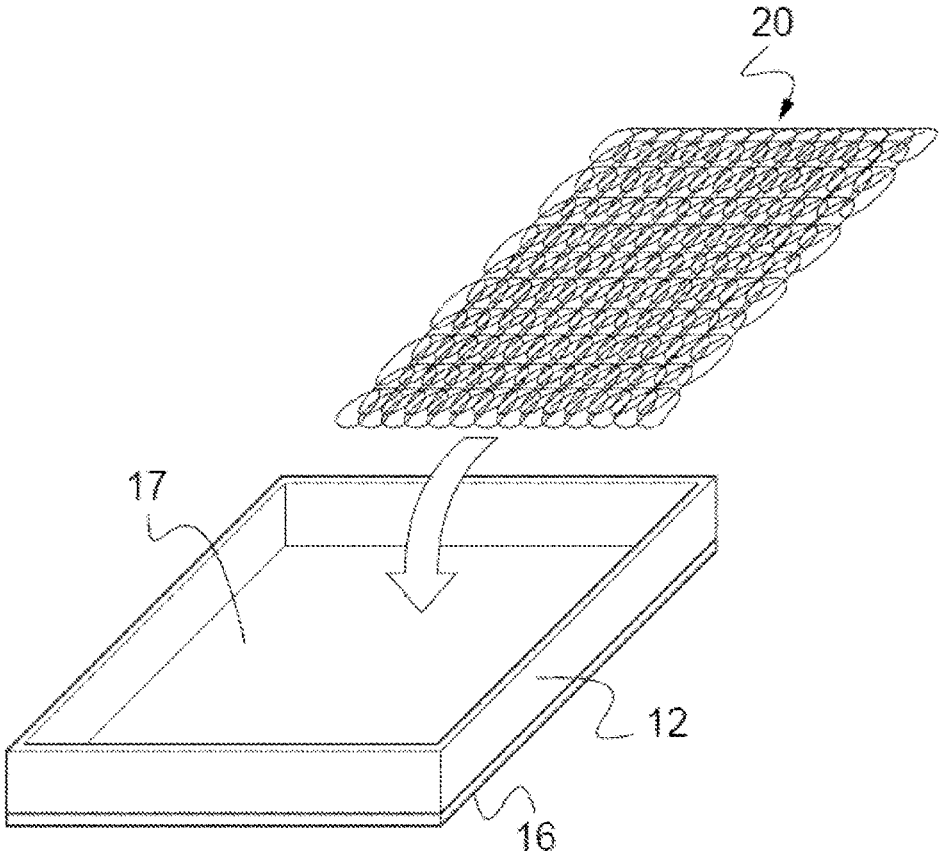

[Fig. 3]
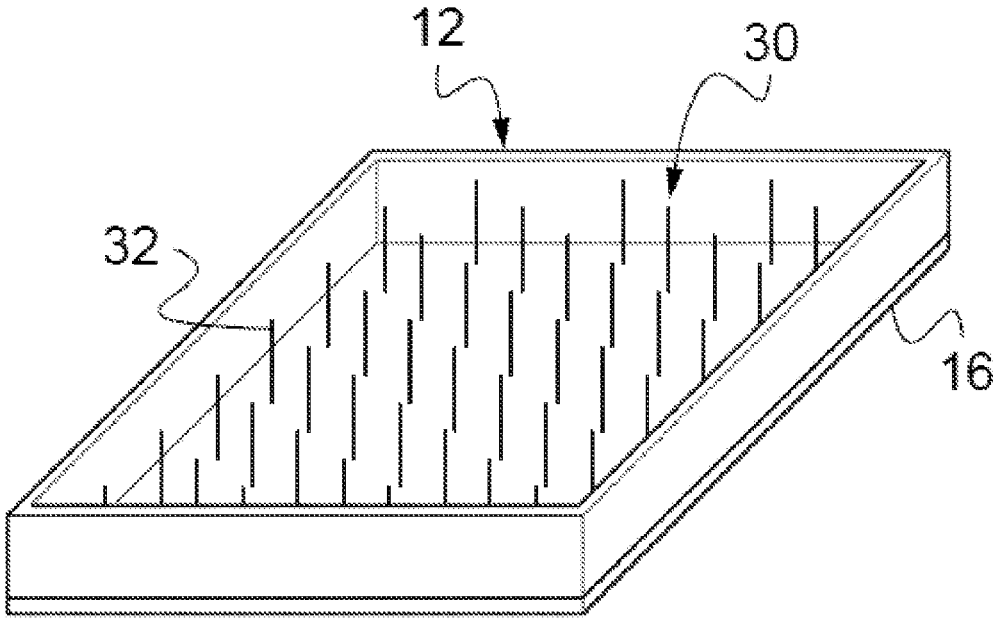

[Fig. 4]
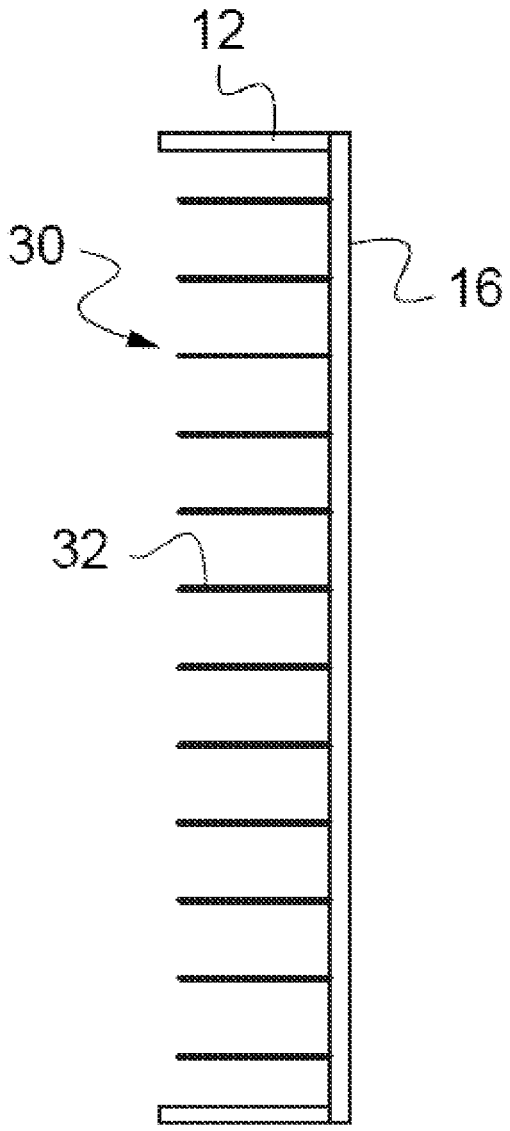

[Fig. 5]
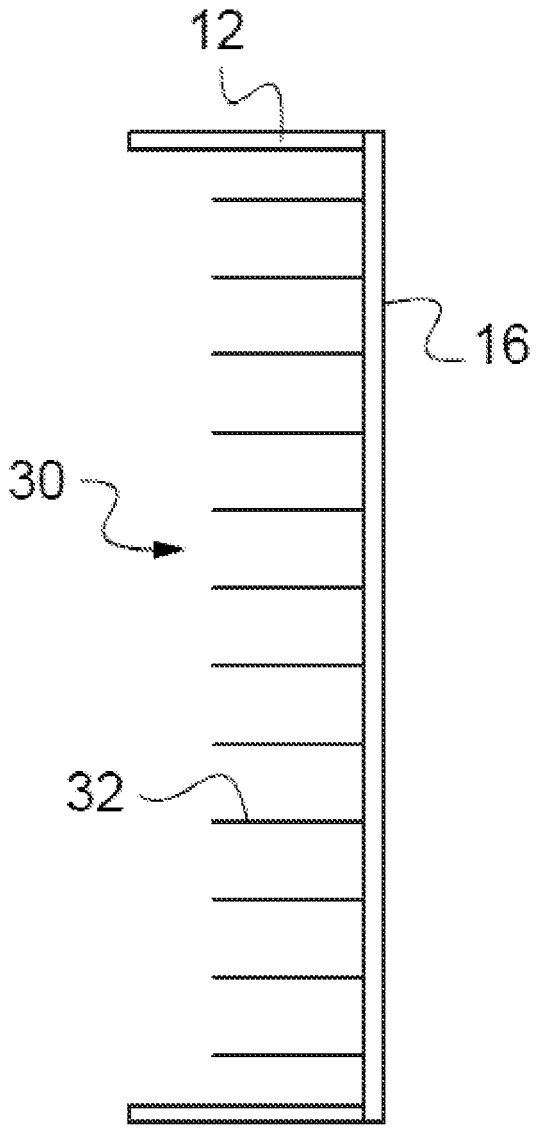

[Fig. 6]
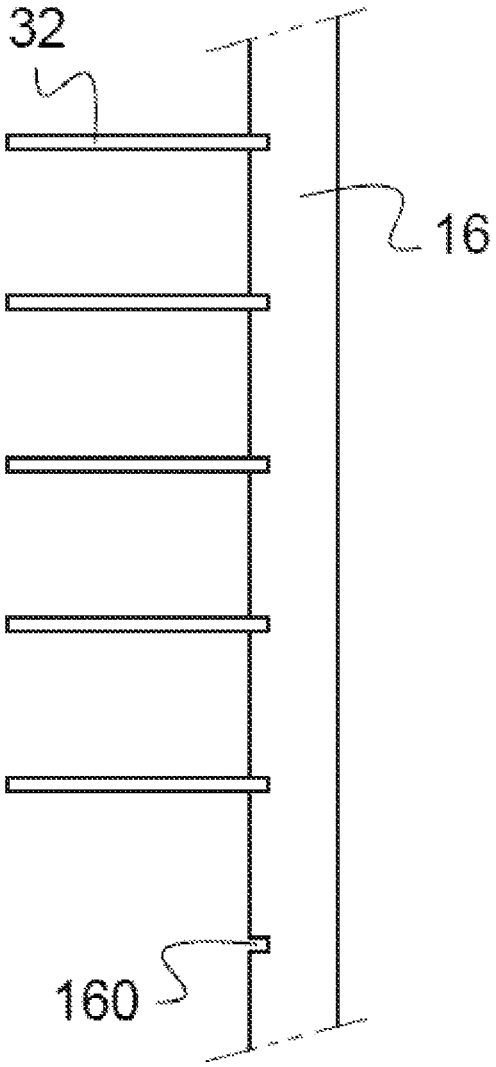

[Fig. 7]
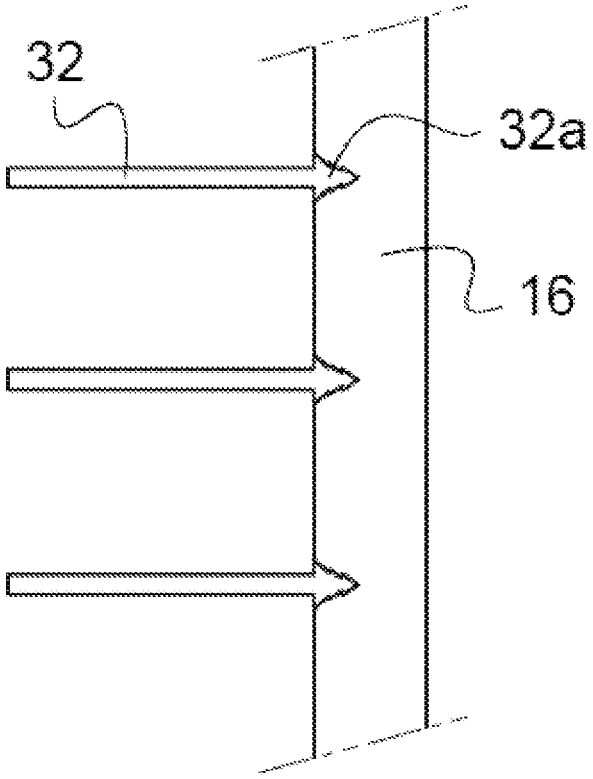

[Fig. 8]
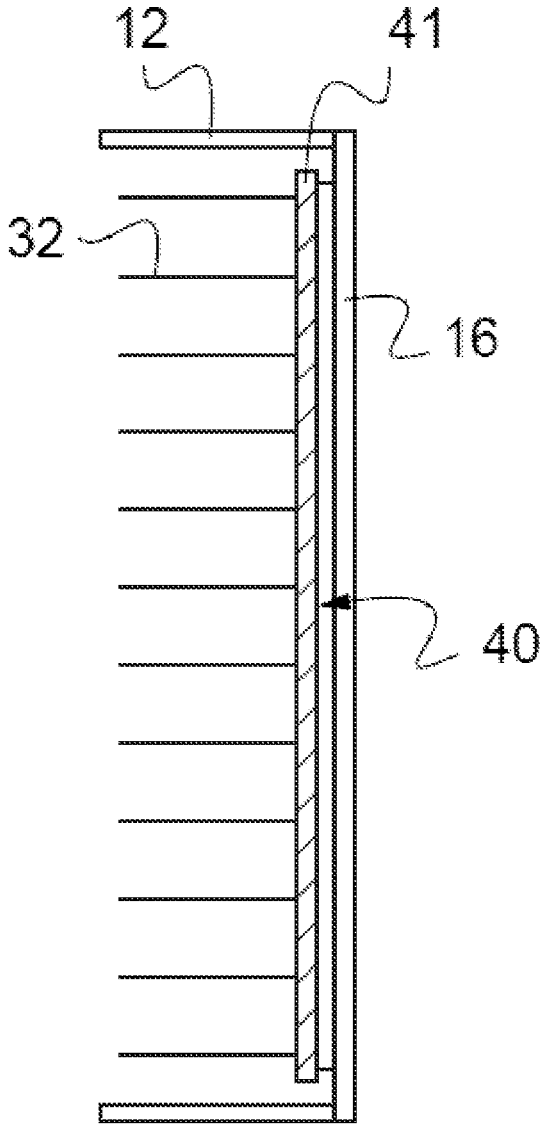

[Fig. 9]
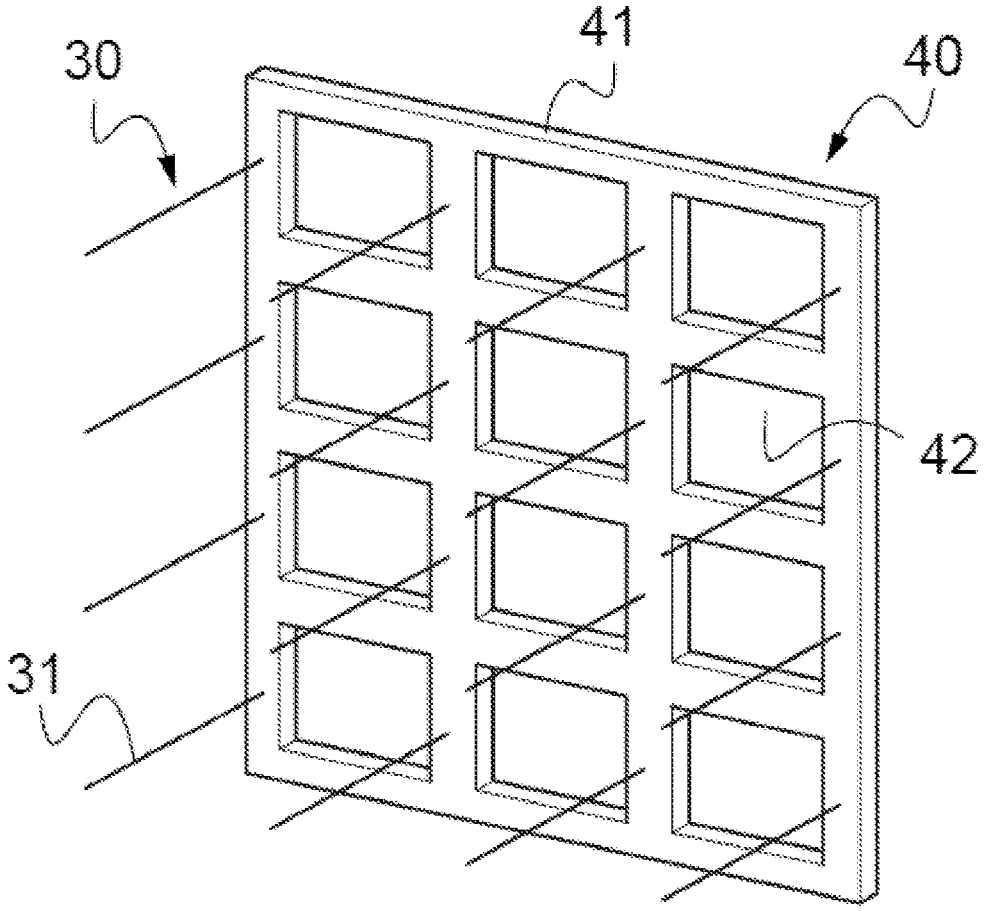

[Fig. 10A]
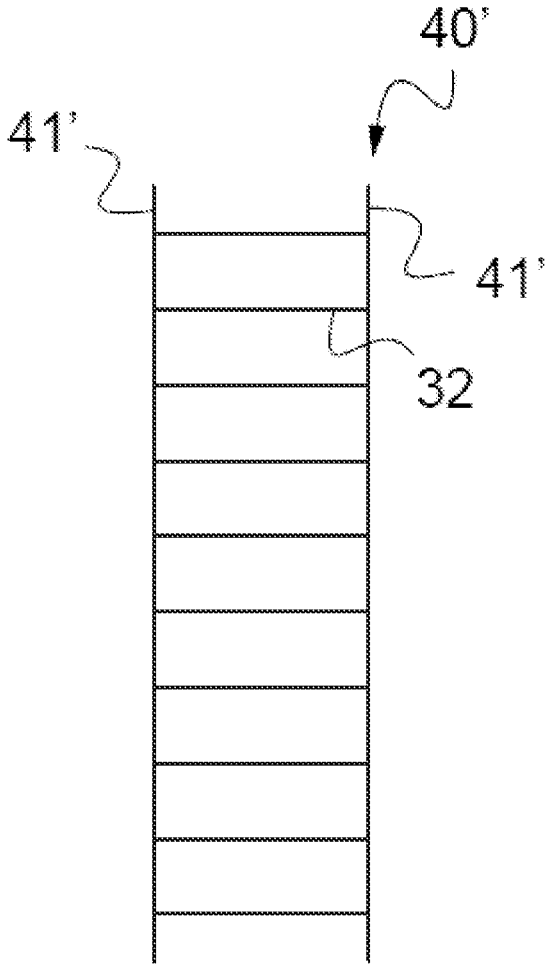

[Fig. 10B]
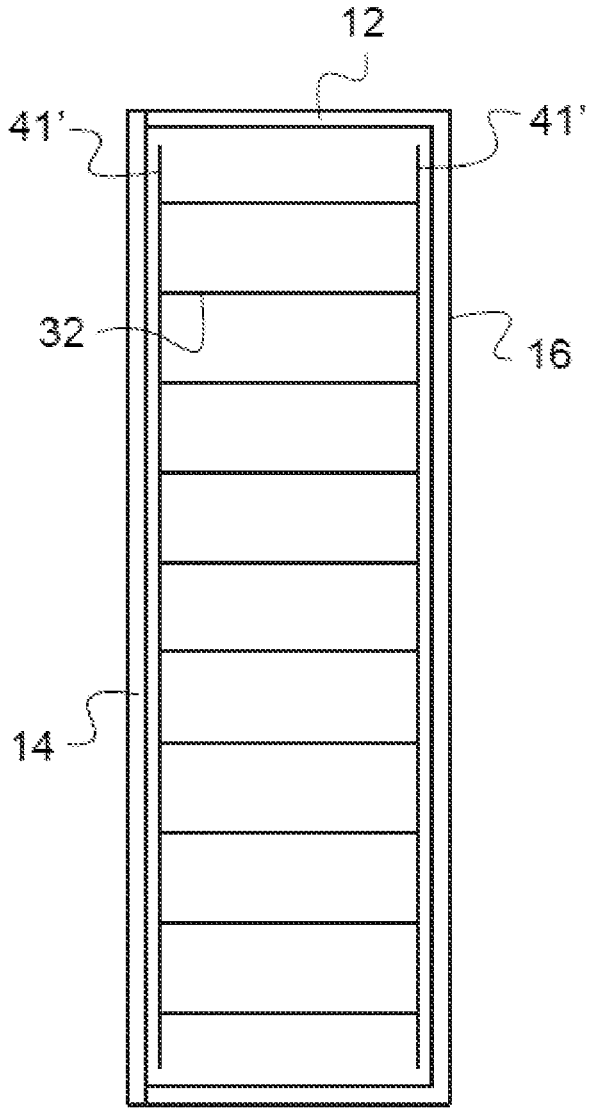

[Fig. 11]
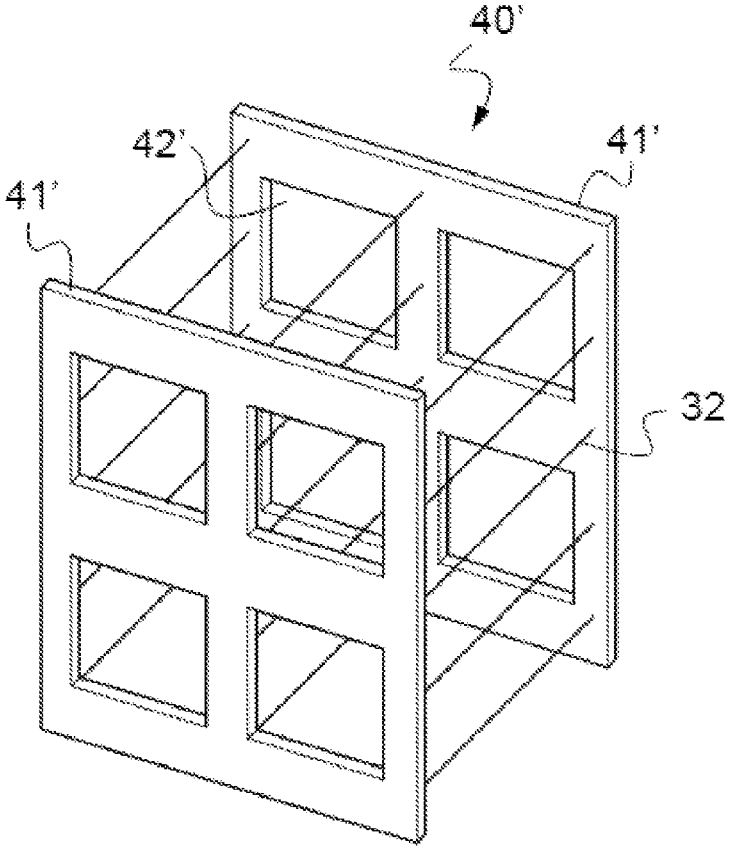
[Fig. 12]
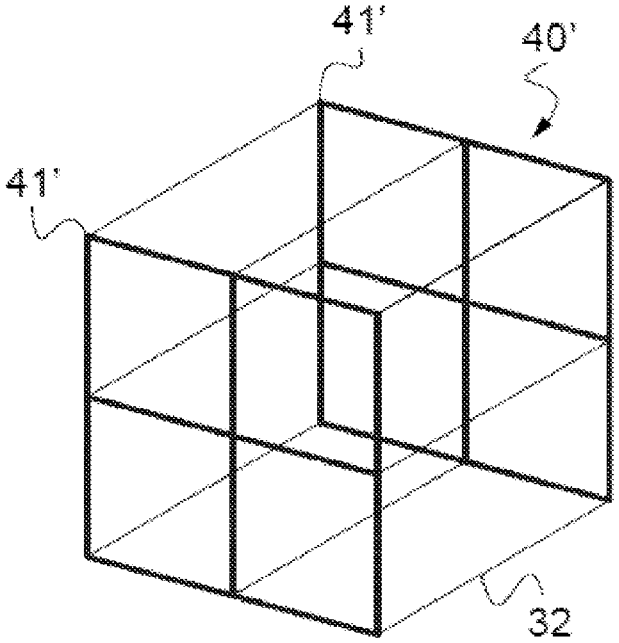

[Fig. 13]
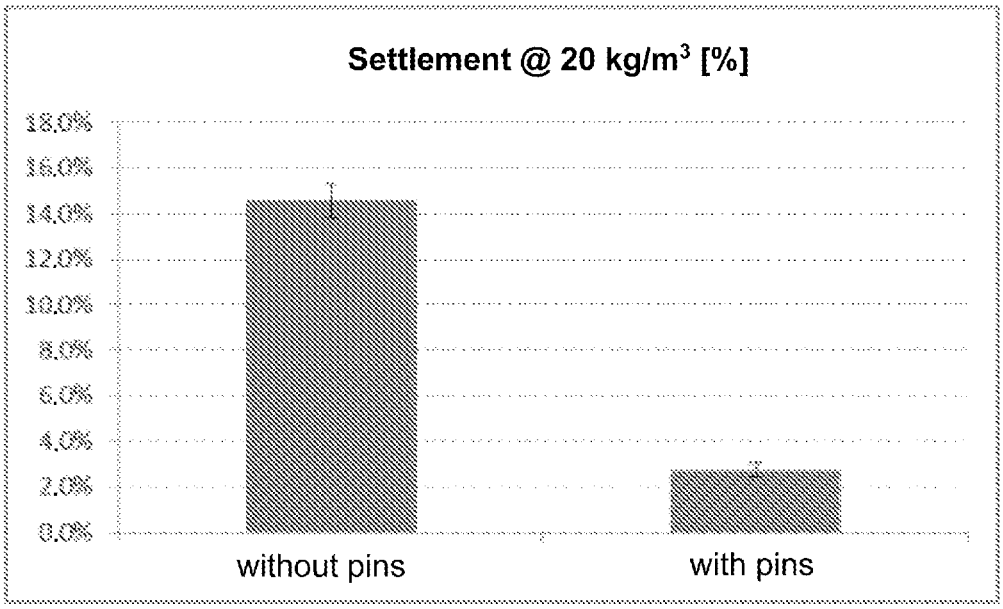

PREFABRICATED INSULATING PANEL

CROSS-REFERENCE TO RELATED APPLICATIONS

This application is the U.S. National Stage of PCT/FR2022/051357, filed Jul. 6, 2022, which in turn claims priority to French patent application number 2107432 filed Jul. 8, 2021. The content of these applications are incorporated herein by reference in their entireties.

The present invention belongs to the field of prefabricated panels.

PRIOR ART

In construction, there is the possibility of producing walls on the principle of prefabrication. These walls are composed of a plurality of prefabricated panels. Each panel consists of a frame closed by two plates: a front plate and a rear plate made of a plaster or wood-type material. This frame and these plates form a housing in which an insulating material is placed. This insulating material may be a mineral wool in the form of flakes.

For this, the frame is attached to the rear plate, said rear plate then being placed flat/horizontal so that the insulating material can be placed in the space defined by said rear plate and the frame. This horizontal position of the rear plate makes it possible to place the insulating material while ensuring a good distribution of the latter and thus a homogeneity of the thermal performance.

The front plate is then attached to the frame in order to close the panel.

The disadvantage of these panels is that, during their transport, they are generally placed on edge, that is to say on the frame. This positioning is the result of the dimensions of the panels.

However, in this position on edge, the insulating material is more sensitive to impacts occurring during its transport. These impacts tend to create a settlement of said material in the housing. Such settlement is characterized by an appearance of empty areas (or thermal bridges) because the mineral wool flakes agglomerate together. Thus, the result of this is that the flakes are no longer uniformly distributed, causing a reduction in the thermal performance of the panels.

SUMMARY OF THE INVENTION

The present invention seeks to solve the problems of the prior art by providing a prefabricated panel for a wall, the thermal performance of which has less deterioration following impacts, in particular following transport.

To this end, the invention relates to an insulating panel comprising a bottom and a lid linked at their periphery by a side wall forming a housing in which an insulating material is placed, characterized in that said insulating panel further comprises retention means for retaining the insulating material in said panel and preventing it from collapsing.

According to one example, the retention means comprise spikes extending from the bottom of the insulating panel.

According to one example, the spikes extend from a structure attached to the bottom of the insulating panel.

According to one example, the structure comprises a flexible sheet from which the spikes extend, arranged in the housing of the insulating panel.

According to one example, the structure comprises two parallel flexible sheets from which the spikes extend, arranged in the housing of the insulating panel.

According to one example, the spikes are integral with the structures at the interweaving of the wires.

According to one example, the spikes extend orthogonally to the bottom and to the lid.

According to one example, the spikes have a length equal to at least 25% of the distance between the bottom and the lid, preferably at least 50% of the distance between the bottom and the lid and even more preferably at least 75%.

According to one example, the spikes are spaced apart by a distance of 2 to 20 cm, preferably of 2 to 15 cm, and more preferably of 5 to 10 cm.

According to one example, the distance between the spikes is constant.

According to one example, the spikes are positioned to be aligned in the form of a grid.

According to one example, the spikes are positioned to be staggered.

According to one example, the spikes are made of a metal or plastic material.

According to one example, the insulating material is in the form of flakes.

According to one example, the insulating material has a density of between 10 and 75 kg/m3, preferably of between 15 and 45 kg/m3.

The invention further relates to a wall composed of a plurality of insulating panels according to one of the preceding claims, said insulating panels being interrelated.

The invention also relates to a method for assembling an insulating panel according to the invention, characterized in that it comprises the following steps:

- Providing the bottom to which the lateral wall has been pre-attached;
- Providing retention means and attaching them to the bottom;
- Placing the panel horizontally on the bottom;
- Providing the insulating material and pouring it into the space defined by the bottom and the side wall;
- Providing the lid and closing the insulating panel therewith.

BRIEF DESCRIPTION OF THE FIGURES

Other particular features and advantages will become clear from the following description thereof, given by way of indication and entirely nonlimitingly, with reference to the appended drawings, in which:

FIG. 1 schematically shows a prefabricated panel according to the invention;

FIG. 2 schematically shows an open panel according to the invention;

FIG. 3 schematically shows an open panel provided with retention means according to the invention;

FIG. 4 schematically shows a profile view of an open panel provided with retention means according to the invention;

FIG. 5 schematically shows a profile view of a variant of an open panel provided with retention means according to the invention;

FIGS. 6 and 7 schematically show variants of fastening of the retention means to the prefabricated panel according to the invention;

FIGS. 8 and 9 schematically show a variant of the retention means using a structure;

FIGS. 10*a*, 10*b*, 11 and 12 schematically show a variant of the retention means using a double structure.

FIG. 13 shows a diagram of the percentage of settlement according to the invention and according to the prior art.

DETAILED DESCRIPTION

FIG. 1 depicts a panel 10 according to the invention. Such a panel comprises a frame 12 or side wall, preferably rectangular or square, closed by two plates, front plate 14 called lid and rear plate 16 called the bottom. The frame 12 and the two plates 14, 16 are arranged so that the two plates are preferably parallel to one another.

The frame is, for example, made up of wood slats and the plates are made from a material based on plaster or wood.

This panel has dimensions such that the panel has a height of between 1 and 6 m, a width of between 1 and 6 m and a depth of between 10 and 60 cm.

The frame 12 and the two plates 14, 16 form a housing 17 or space wherein an insulation material 20 is placed, as can be seen in FIG. 2. This insulating or insulation material 20 is a material of the mineral wool type such as glass wool or rock wool or an insulating material of the wood wool type.

In the case of mineral wool of the glass wool type, this is in the form of flake or nodules having a density of 10 to 75 kg/m3, preferably of 15 to 45 kg/m3.

In order to manufacture such a panel, the frame 12 and the rear plate 16 are attached and then placed flat, resting on the rear plate. This positioning makes it possible to have access to the space formed by said rear plate 16 and the frame 12.

This space 17 can be filled with the insulating material before it is closed by the front plate.

Expediently, according to the invention, the panel 10 comprises retention means 30 as can be seen in FIG. 3. These retention means 30 are means making it possible to maintain the flakes in place during the transportation of the panel, that is to say when it is handled, subjected to impacts and positioned in different ways on one or the other of its faces.

These retention means 30 comprise a plurality of spikes 32, that is to say at least two spikes. These spikes 32 are in the form of rods. It will then be understood that these spikes 32 are elements whose cross section has a negligible diameter relative to their lengths. These spikes or rods 32 are arranged in the panel so as to extend in a direction substantially orthogonal to the plane of the front 14 or rear 16 plates as can be seen in FIGS. 3 and 4. It is understood by this that the spikes 32 or rods extend orthogonally to the plane of the plates or are inclined at most 45 degrees relative to an axis orthogonal to the plane of the plates.

The function of this plurality of spikes 32 is to increase the friction that there may be between the flakes themselves and between the flakes and the structure of the panel. This increase in friction tends to provide better holding of the flakes during impacts, in particular during transport.

For this effect to be perceptible, the invention proposes having a plurality of spikes 32 distributed in the panel.

The spikes 32 are made of a metal or plastic or wood material.

Preferably, the material used has thermal properties so that the presence of the spikes does not disrupt the performance of the panel.

In one example of a panel having a height of 550 mm, a width of 550 mm and a thickness of 165 mm and 42 spikes, for an insulating material having a density of 20 kg/m3, the diagram shown in FIG. 13 wherein it can be seen that the settlement for a panel without spikes is more than 14% whereas it is of the order of 3% with the presence of spikes.

According to the invention, the number of spikes 32 is such that the spacing between two spikes is between 2 and 20 cm, preferably from 2 to 15 cm, and preferentially from 5 to 10 cm.

This spacing varies according to the density of the insulating material. Indeed, as can be seen below with a panel having a height of 550 mm, a width of 550 mm and a thickness of 165 mm, several configurations of spacing (5 and 8.5 cm) and of density (20, 30 and 40 kg/m3) were tested. The table below shows the settlement (in mm) for different densities of insulating materials and for spacings between different spikes.

| Settlement in mm | 5 cm spacing | 8.5 cm spacing |
|---|---|---|
| Insulating material density: 20 kg/m$^3$ | 15 | 20-25 |
| Insulating material density: 30 kg/m$^3$ | 15 | 5-10 |
| Insulating material density: 40 kg/m$^3$ | 5-10 | 0 |

As a result, for a given spacing, the increase in density makes it possible to reduce the settlement. It is also found that the settlement performance varies depending on the density. Thus, it seems that for a low density, a small spacing is effective whereas for a high density, a higher spacing can be effective.

This spacing between the spikes 32 is preferably constant, but it is quite possible for it to be variable. Thus, it is possible that the spacing of the spikes located at the center of the panel differs from that of the spikes located at the periphery, or simply that areas of the panel have spikes 32 having a different spacing.

The spacing between the spikes 32 is such that the spikes are positioned to be aligned in the form of a grid, or are staggered.

Likewise, the height of the spikes 32 is an adjustable variable. It is not necessary for the spikes to extend over the entire thickness of the panel. Indeed, the operation of the present invention is based on the presence of the spikes or rods which make it possible to increase the friction and the holding of the flakes.

Thus, spikes 32 having a length at least equal to 25% of the depth of the panel, as can be seen in FIG. 5, have an effect on the settlement.

Preferably, the spikes have a length equal to at least 50%, or even 75%, and even more preferably 100% of the depth.

The advantage of the spikes and their distribution in the panel is to increase the holding of the flakes in the housing without having to partition said housing, thus avoiding intermediate settlements. Indeed, the spikes are used to obtain better holding of the flakes by increasing the friction there may be between the flakes themselves and between the flakes and the structure of the panel. The spacing between the spikes allows the flakes to have freedom of movement. Thus, the association of the spikes and the spacing between the spikes allows the flakes to have a holding in the panel that limits the settlement, without partitioning said panel. These retention means 30 are arranged in the panel before it is filled with the insulating material.

For the integration of the spikes in the panel, several embodiments are possible.

In a first embodiment, the spikes 32 are directly attached to the rear plate 16 as can be seen in FIG. 6. Each spike 32 is then attached to the plate by bonding. For this, the plate is optionally marked with a plurality of blind holes 160 each corresponding to the position of a spike. Each spike is then placed in a hole then glued.

Alternatively, each spike 32 is provided with a fastening head 32*a* enabling said spike to be screwed onto the rear plate as shown in FIG. 7.

Thus, the spikes 32 according to this first embodiment are attached to the rear plate 16 before or after its assembly with the frame 12 but before the filling with the insulating material.

In a second embodiment, the spikes 32 are attached to the panel via a structure 40. This structure 40 is in the form of a sheet 41 from which the spikes extend. These spikes 32 are elements attached to the sheet 41 but may be of a material/integral with the sheet 41.

In the case where the spikes 32 are added elements, the spikes 32 and the sheet 41 form the structure; they can be made of the same material or of a different material. Thus, it is possible to have a wood structure and metal or plastic spikes or a metal sheet and metal spikes.

In the case where the spikes 32 and the sheet 41 are integral, the material of the spikes and the sheet is identical. This makes it possible, in the case of wood or metal, to produce the sheet and spike assembly by machining, whereas in the case of plastic, injection molding can be used. Of course, all possible methods making it possible to obtain this sheet-spikes assembly can be used.

In this second embodiment, the sheet 41 provided with the spikes 32 is attached to the rear plate 16 as can be seen in FIG. 8. This attachment allows the sheet to remain in place regardless of the orientation of the panel. This attachment can be done by nailing, stapling, gluing, screwing or by a snap-fastening system.

In a variant that can be seen in FIG. 9, the flexible sheet 41 from which the spikes extend is perforated, that is to say that it comprises a multitude of openings 42. These openings 42 are made firstly to lighten the structure 40. Indeed, this flexible sheet 41 provides a useless additional weight.

Secondly, these openings limit the influence of the flexible sheet 41 on the thermal performance. Indeed, it is possible that the material used for the flexible sheet 41 is not a good thermal insulator so as to degrade the thermal performance of the insulating panel. In order to limit this degradation, the openings 42 make it possible to limit the amount of material that is not very efficient.

In this second embodiment, the spikes 32 and the flexible sheet 41 are fixed to the rear plate, before or after its assembly with the frame, but before the filling with the insulating material.

In a third embodiment, the spikes 32 of the retention means 30 are attached via a double structure 40'. This double structure 40' comprises two flexible sheets 41' between which spikes 32 extend, as can be seen in FIGS. 10*a* and 10*b*. These two sheets are preferably parallel to one another.

Like the second embodiment, the flexible sheets 41' and the spikes 32 can be made of different materials: wood, plastic, metal, or can be made of the same material, they can be made of material or can be attached to one another by gluing, nailing, stapling, screwing, snap-fastening, or by any other means.

Given that the insulating material is placed in the panel after placing the retention means, said means must be designed to allow the insulating material to fill said panel. For this, the flexible sheet not attached or in contact with the rear plate is perforated, that is to say it comprises multiple openings allowing the insulating material to be inserted between the two flexible sheets 41'.

In a preferred embodiment, these openings are also made on the flexible sheet 41' attached or in contact with the rear plate. These openings make it possible to limit the weight of the flexible sheets 41' but also to limit performance degradation. Indeed, with a flexible sheet 41' fully in contact with the rear plate, there is the risk of degradation of the performance of the panel if this flexible sheet 41' is made of a material which itself has poor thermal performance.

With openings, the influence of this material is lessened and therefore the performance degradation also decreases.

In the case where the two flexible sheets 41' are perforated as seen in FIG. 11, that is to say, they comprise openings, these openings must not disturb the arrangement of the spikes 32. For this, the two flexible sheets 41' are preferably perforated in a similar way so that the openings of the two flexible sheets 41' are facing one another two by two.

In an even more preferred embodiment, the two flexible sheets 41' are each replaced by a grid formed by interwoven wires, as can be seen in FIG. 12. These two grids are connected together by the spikes, the latter extending from the wires forming the grids. The two flexible sheets and the spikes form a framework such as a mesh.

This grid-shaped configuration advantageously makes it possible to limit the amount of material liable to degrade the performance of the panel while allowing good filling of the panel with the insulating material.

For this third embodiment, although it is possible that all the spikes extend between the two sheets or grids, that is to say they are in contact with the two sheets or grids, it is alternatively possible that this is not the case.

Indeed, it is feasible that one portion of the spikes 32 extends in contact with both sheets or grids and that the other portion of the spikes does not. Thus, it would be possible to have spikes extending from either of the sheets or grids without being in contact with both sheets or grids.

The spikes in contact with both sheets or grids have an additional function, a structural one, which consists in holding the two sheets or grids spaced apart from one another.

Of course, the present invention is not limited to the illustrated example but is susceptible to various variants and modifications which will become apparent to the person skilled in the art.

Thus, it may be possible for the spikes to be able to be attached to the rear plate and to the front plate or to the front plate.

The invention claimed is:

1. An insulating panel comprising:

a bottom and a lid linked at their entire periphery by a side wall extending along the entire periphery, thereby forming an enclosed housing in which an insulating material is placed, the enclosed housing comprising a bottom face, an upper face and an interior side face, and a retention system adapted to retain the insulating material in said panel and to prevent the insulating material from collapsing, wherein said retention system comprises spikes extending from the bottom face of the insulating panel or from a structure attached to the bottom face of the insulating panel, each spike terminating at a free end that is positioned between the bottom face and the upper face, wherein the insulating material is in the form of flakes.

2. The insulating panel according to claim 1, wherein the structure comprises a flexible sheet, from which the spikes extend, arranged in the housing of the insulating panel.

3. The insulating panel according to claim 1, wherein the structure comprises two parallel flexible sheets, from which the spikes extend, arranged in the housing of the insulating panel.

4. The insulating panel according to claim 2, wherein the flexible sheets are interwoven wires forming meshes.

5. The insulating panel according to claim 4, wherein the spikes are integral with the structures at the interweaving of the wires.

6. The insulating panel according to claim 1, wherein the spikes extend orthogonally to the bottom and to the lid.

7. The insulating panel according to claim 1, wherein the spikes have a length equal to at least 25% of a distance between the bottom and the lid.

8. The insulating panel according to claim 1, wherein the spikes are spaced apart by a distance of 2 to 20 cm.

9. The insulating panel according to claim 1, wherein a distance between the spikes is constant.

10. The insulating panel according to claim 1, wherein the spikes are positioned to be aligned in the form of a grid.

11. The insulating panel according to claim 1, wherein the spikes are positioned to be staggered.

12. The insulating panel according to claim 1, wherein the spikes are made of a metal or plastic material.

13. The insulating panel according to claim 1, wherein the insulating material has a density of between 10 and 75 kg/m3.

14. A wall composed of a plurality of insulating panels according to claim 1, said insulating panels being attached to one another.

15. The insulating panel according to claim 7, wherein the spikes have a length equal to at least 55% of the distance between the bottom and the lid.

16. The insulating panel according to claim 8, wherein the spikes are spaced apart by a distance of 2 to 15 cm.

17. The insulating panel according to claim 13, wherein the density is between 15 to 45 kg/m3.

18. The insulating panel according to claim 1, wherein the panel has a height of between 1 and 6 m, a width of between 1 and 6 m, and a depth of between 10 and 60 cm.

19. A method for manufacturing an insulating panel according to claim 1, comprising:

providing the bottom to which the lateral wall has been pre-attached;

providing a retention system and attaching the retention system to the bottom;

placing the panel horizontally on the bottom;

providing the insulating material and pouring it into a space defined by the bottom and the side wall, and providing the lid and closing the insulating panel therewith.

20. An insulating panel comprising:

a bottom and a lid linked at their entire periphery by a side wall extending along the entire periphery, thereby forming an enclosed housing in which an insulating material is placed, the enclosed housing comprising a bottom face, an upper face and an interior side face, and a retention system adapted to retain the insulating material in said panel and to prevent the insulating material from collapsing, wherein said retention system comprises spikes extending from the bottom face of the insulating panel or from a structure attached to the bottom face of the insulating panel, each spike terminating at a free end that is positioned between the bottom face and the upper face, wherein the insulating material is in the form of flakes, wherein the spikes are spaced apart by a distance of 2 to 20 cm, and wherein the insulating material has a density of between 10 and 75 kg/m$^3$.

* * * * *